US008600089B2

(12) United States Patent
Wenzel et al.

(10) Patent No.: US 8,600,089 B2
(45) Date of Patent: Dec. 3, 2013

(54) LIGHT ACTIVATED HEARING DEVICE

(75) Inventors: Gentiana I. Wenzel, Hannover (DE); Hubert H. Lim, Hannover (DE); Thomas Lenarz, Hannover (DE); Holger Lubatschowski, Hannover (DE)

(73) Assignee: Medizinische Hochschule Hannover, Hannover (DE)

( * ) Notice: Subject to any disclaimer, the term of this patent is extended or adjusted under 35 U.S.C. 154(b) by 59 days.

(21) Appl. No.: 13/146,804

(22) PCT Filed: Feb. 1, 2010

(86) PCT No.: PCT/EP2010/051211

§ 371 (c)(1), (2), (4) Date: Oct. 6, 2011

(87) PCT Pub. No.: WO2010/086453

PCT Pub. Date: Aug. 5, 2010

(65) Prior Publication Data

US 2012/0020504 A1 Jan. 26, 2012

Related U.S. Application Data

(63) Continuation-in-part of application No. 12/363,291, filed on Jan. 30, 2009, now Pat. No. 8,545,383.

(51) Int. Cl.
*H04R 25/00* (2006.01)

(52) U.S. Cl.
USPC ..... 381/326; 381/312; 381/322

(58) Field of Classification Search
USPC ..... 381/326, 328, 312, 315, 322, 324; 600/25; 607/57; 623/10
See application file for complete search history.

(56) References Cited

U.S. PATENT DOCUMENTS

2006/0161227 A1* 7/2006 Walsh et al. ..... 607/88

FOREIGN PATENT DOCUMENTS

EP 0 377 547 7/1990
WO WO 2005/089497 9/2005

(Continued)

OTHER PUBLICATIONS

Izzo, A. et al. "Optical Parameter Variability in Laser Nerve Stimulation: A Study of Pulse Duration, Repetition Rate, and Wavelength" (IEEE Transactions on Biomedical Engineering, vol. 54, No. 6, pp. 1108-1114, published Jun. 2007).*

(Continued)

*Primary Examiner* — Suhan Ni
(74) *Attorney, Agent, or Firm* — Greer, Burns & Crain Ltd.

(57) ABSTRACT

The invention relates to a hearing aid device for humans with impaired hearing, who have an at least partially functional cochlea and a functional nervous signalling pathway from the cochlea via the auditory nerve to the brain. The hearing aid device contains a receiver, a transducer of the sound or other acoustic signals into electrical current serving as a signal representing a sound, a pulsed irradiation source connected to the transducer for receiving the electrical current and for generating modulated pulsed irradiation in dependence from the electrical current, and preferably one or more optical fibers optically coupled to the exit of the pulsed irradiation source, wherein the optical path for conduction of irradiation within the device ends directly opposite a functional element of the natural vibration transduction pathway, e.g. adjacent the skull, the tympanic membrane, the hammer, the incus, the stapes, the outside of the cochlea, the otic capsule, the round window membrane, or the oval window membrane.

12 Claims, 6 Drawing Sheets

(56) References Cited

FOREIGN PATENT DOCUMENTS

Figure 1:
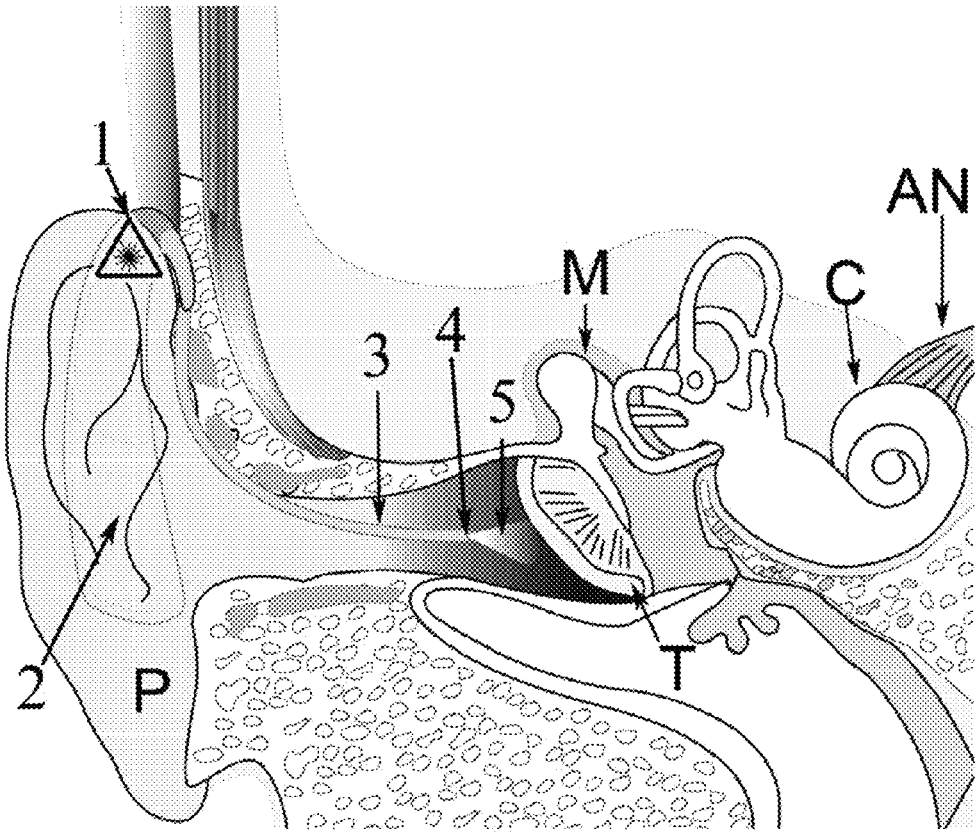

| | | |
|---|---|---|
| WO | WO 2006/042298 | 4/2006 |
| WO | WO 2007/013891 | 2/2007 |

OTHER PUBLICATIONS

Fridberger, A. et al., "Local Mechanical Stimulation of the Hearing Organ By Laser Irradiation", *Nueroreport*, vol. 17, No. 1, Jan. 23, 2006.

Izzo, Agnella D. et al., "Optical Parameter Variability in Laser Nerve Stimulation: A Study of Pulse Duration, Repetition Rate and Wavelength", *IEEE Transactions on Biomedical Engineering*, vol. 54, No. 6, Jun. 2007 pp. 1108-1114.

Izzo, Agnella D. et al., "Laser Stimulation of Auditory Neurons: Effect of Shorter Pulse Duration", *Biophysical Journal*, vol. 94, Apr. 2008, pp. 3159-3165.

Izzo, Agnella D. et al., "Laser Stimulation of the Auditory Nerve", *Lasers in Surgery and Medicine*, vol. 38, 2006, pp. 745-753.

Richter, Claus-Peter et al., "Optical Stimulation of Auditory Neurons: Effects of Acute and Chronic Deafening", *Hearing Research*, vol. 242, 2008, pp. 42-51.

Wenzel, Gentiana I. et al., "Laser Irradiation of the Guinea Pig Basilar Membrane", *Lasers in Surgery and Medicine*, vol. 35, 2004, pp. 174-180.

Wenze Gentiana I. et al., "Laser-Induced Collagen Remodeling and Deposition within the Basilar Membrane of the Mouse Cochlea", *Journal of Biomedical Optics*, vol. 12, No. 2, Mar./Apr. 2007, pp. 021007-1-021007-7.

* cited by examiner

LIGHT ACTIVATED HEARING DEVICE

The invention relates to a hearing aid device for humans having at least one functional cochlea. The hearing aid device contains one or more optical fibres for stimulating the outside of the cochlea of a human with impaired hearing. In greater detail, the invention provides a device which has one or a plurality of optical fibres for the conduction of stimulating pulsed signals to the end section of the optical fibres for activating the cochlea while circumventing non-functional elements of the natural pathway that transmits vibration signals to the cochlea, e.g. circumventing an obstructed outer ear canal, a non-functional tympanic membrane, and/or a non-functional member of the ossicular chain, malformed outer and middle ear, or unilateral deafness. Further, the invention relates to a process for stimulating the cochlea using the device, and to a process for producing the device.

STATE OF THE ART

WO 2006/042298 describes a photo-mechanical hearing aid, wherein the tympanic membrane is activated by mechanical vibration signals, which are generated by a transducer in response to optical signals received by the transducer. The transducer is attached to the tympanic membrane. The transducer is therefore not mechanically coupled to the generator producing the optical signals and can therefore stimulate the tympanic membrane or, alternatively, a bone in the ossicular chain, an external portion of the cochlea, or a portion elsewhere between the tympanic membrane and the cochlea in the hearing transduction pathway by mechanical vibration signals without interference from mechanical coupling to an outside component.

U.S. Pat. No. 6,537,200 B2 describes a hearing system for implantation of its transducer section into the auditory canal. For transmission of auditory signals, mechanical transducer vibrations are mechanically transported by a coupling element that is coupled to an ossicle of the ossicular chain, from which they can cause a corresponding hearing impression along the natural pathway.

U.S. Pat. No. 6,137,889 describes a hearing aid that transmits vibrations via a vibrationally conductive assembly to the tympanic membrane. The vibrationally conductive assembly comprises a tympanic coupling element, e.g. a coupling pad, which is placed on the tympanic membrane for transmission of the mechanical vibrations.

In the intact ear, sound pressure waves from the environment travel through the external auditory canal, are then transmitted through the ear drum and middle ear ossicles to the fluid within the cochlea. The fluid movement within the cochlea induces the depolarization of the sensory epithelium formed by hair cells. This depolarisation is transformed into nervous signals which are transmitted from the base of the hair cells to the dendrites of the spiral ganglion, which is the first neuron on the auditory pathway, and from the spiral ganglion further to the central auditory system, and finally reaching the auditory cortex to elicit a sound perception. The nervous signals which are transmitted via the spiral ganglion cells to the central auditory system can be recorded as auditory bra instem responses (ABR).

Wenzel et al. in Journal of Biomedical Optics 12(2) 021007 (2007) and WO 2005/089497 A2 describe the manipulation of the hearing impression by modifying the stiffness of the basilar membrane within the inner ear. The basilar membrane is a tuned structure based on its biophysical properties mass stiffness and damping. These again are dependent on the structural molecules collagen, glycosaminoglycans and proteoglycans. The collagen fibres are regarded as the main source for the stiffness of the basilar membrane. Accordingly, changing the structure of the collagen fibres of the basilar membrane would induce changes in the tuning characteristics of the basilar membrane and consequently changes of the cochlear frequency map, i.e. a characteristic response frequency of the irradiated sections of the cochlea. The basilar membrane has been stained with trypan blue and irradiated with a 694 nm ruby laser, 3 ms pulses and using a 600 μm core diameter optic fibre. Wenzel et al. demonstrated that laser irradiation of trypan blue stained basilar membrane in vivo induced collagen remodelling within 14 days after laser irradiation.

Wenzel et al. in Lasers in Surgery and Medicine 35: 174-180 (2004) describe ex vivo experiments demonstrating that collagen changes within the basilar membrane can be induced by laser irradiation of a trypan blue stained basilar membrane. Wenzel et al. discuss that laser irradiation to the cochlea might be used for the therapy of partial hearing loss by changing the frequency responsiveness of the cochlea through collagen remodelling within the basilar membrane. Wenzel et al. indicate that laser treatment of the basilar membrane carries a substantial risk of damaging the neural epithelium by thermal effects of the laser treatment.

The state of art as represented by WO 2005/089497 and Wenzel et al. modifies the frequency response of the basilar membrane by laser treatment of the basilar membrane, resulting in the stiffening of the basilar membrane and hence in a modified frequency map. These publications do not relate to a permanent implant but use a laser for modulating the frequency response behaviour of the cochlea by treatment with a laser. The evocation of auditory nerve signals in response to laser irradiation therefore is not employed.

WO 2007/013891 A2 describes a cochlea implant for placing into the cochlea for stimulating auditory neurons, the implant comprising optical fibres for guiding laser irradiation to a target site of auditory neurons. The auditory neurons which are associated with spiral ganglion cells are stimulated by irradiation with a tunable pulsed laser, thus circumventing signalling by the hair cells of the organ of Corti, i.e. without requiring a functional hair cell.

Fridberger and Ren in NeuroReport, vol. 17, pages 33-37 (2006) quote that laser light can accelerate small objects, and they come to the conclusion that a moderately powerful laser might provide sufficient force to move the organ of Corti. In agreement with their initial considerations that movement of the organ of Corti depends on the power of the laser applied, a 1.3 W laser diode was used at 50 μs pulses separated by 500 ms for stimulation of one cochlear segment while recording mechanical responses from an adjacent segment. Experiments demonstrated that the mechanical response from the basilar membrane was in the form of an oscillating motion which decayed to zero response in approximately 500 μs, which indicates a decline in cochlear sensitivity, damage of the pathway for nervous signal generation and/or damage of the pathway for nervous signal transduction.

When aiming the laser at bone surrounding the cochlea, no electrical responses were recorded by Fridberger and Ren. Further, repeated exposure of the cochlea to laser pulses resulted in an abolishment of an evoked response. When aiming the laser at the ossicles of the middle ear, compound action potentials of the auditory nerve could be recorded, which resembled those evoked by acoustic clicks. Similar results were obtained when aiming the laser at the bony bulla, Fridberger and Ren conclude that these responses are artifacts which are caused by local heating of the bony structures due to absorption of the laser light resulting in rapid local heating, which in turn generated sound. The results of Fridberger and Ren indicate as well that the hearing organ is locally resonant when this mode of stimulation is used. Further, it was found that repeated exposure caused a decline in cochlear sensitivity, and further resulted in the inability of the cochlea to record additional mechanical responses. They conclude that the organ of Corti can be moved by forces generated by moderately powerful lasers, but with the laser irradiation having the severe limitation in the finding that heating causes cellular damage. From their results, Fridberger and Ren conclude as well that in clinical laser applications, high power lasers used during middle ear surgery for ablating bone surrounding the cochlea may cause hearing loss as the organ of Corti is sensitive to intense light.

Richter et al. in Hearing Research 242, 42-51 (2008) describe that cochlear implants can be used to successfully stimulate the auditory neurons, especially the spiral ganglions, by application of laser irradiation from an optical fibre. In detail, compound action potentials could be generated by laser stimulation of the spiral ganglion cells also in deafened experimental animals, which were proven not to have functional sensory cells. As with electrical stimulation by electrodes, the auditory nerves are directly stimulated without participation of sensory cells.

Izzo et al. in Biophysical Journal 3159-3166 (2008) describe the stimulation of the auditory nerves by irradiation at a wavelength of 1.94 μm, differing from the 1.85 μm irradiation used for neural activation to spiral ganglion cells in Izzo et al. in IEEE Transactions on Biomedical Engineering, 1180-1114 (2007).

Further, Izzo et al. in Lasers in Surgery and Medicine 745-753 (2006) showed that it is possible to stimulate the auditory nerve with optical radiation, also in animals in which the hair cells were destroyed through a chronic deafening procedure. Optical stimulation of the auditory nerve could be shown to be stable for several hours without causing obvious damages to the cochlea and radiation energy was elevated to up to 20-40 dB. According to Izzo, the nerve signals are evoked by a photothermal effect within the auditory nerve, whereas photomechanical effects of laser irradiation are regarded as secondary effects of rapid tissue heating that produces pressure waves.

The state of art according to WO 2007/013891 and publications of Izzo et al. circumvent the activity of any sensory cells of the ear, e.g. of the organ of Corti, but uses laser pulses for direct stimulation of the auditory nerve. Direct stimulation of the auditory nerve avoids the direct impact of the laser irradiation onto the sensory cells of the organ of Corti, which direct irradiation of the organ of Corti according to Fridberger and Ren causes as a decline in cochlea sensitivity and in an inability to record additional mechanical responses on the basis of their finding that repeated exposure to laser irradiation caused a decline in cochlea sensitivity.

OBJECT OF THE INVENTION

It is an object of the invention to provide an alternative hearing aid device, which allows to induce nerve signals in a patient having an at least partially functional cochlea, which device does not penetrate the cochlea.

GENERAL DESCRIPTION OF THE INVENTION

The invention relates to a hearing aid device for humans or animals with impaired hearing, who have an at least partially functional cochlea and a functional nervous signalling pathway from the cochlea via the auditory nerve to the brain and achieves the objects by providing a device according to claim 1. More specifically, the invention provides a hearing aid device for a hearing impaired human having an at least partially functional cochlea, the device comprising a pulsed light source capable of producing pulsed irradiation, a control unit coupled to the light source for controlling and modulating the frequency of pulsed irradiation, at least one optical fibre optically coupled to the light source for reception of pulsed irradiation produced by the pulsed light source, an optical path formed by the light source and the optical fibre terminating in an output surface for emitting pulsed irradiation, wherein the optical fibres at their end section opposite the light source contain an output surface terminating the optical path, and wherein the optical fibres are dimensioned for positioning the output surface directly opposite and spaced from an at least partially functional element of the natural vibration transduction pathway which is functionally coupled for transduction of vibration to the cochlea, wherein the functional element is selected from the group comprising the skull, the tympanic membrane, the hammer, the incus, the stapes, the outside of the cochlea, the otic capsule, the round window membrane, and the oval window. Preferably, the pulsed light source is a pulsed laser or a comparable light source like for example a light emitting diode (LED). Accordingly, the optical path is dimensioned for termination in an output surface spaced from a member of the natural vibration conduction pathway for irradiating the member across the spacing. The output surface preferably is the cross-sectional surface of an optical fibre, or the surface of a lens arranged at the cross-sectional surface of an optical fibre. Optionally, the output surface is arranged in an angle of 0 to 90° from the longitudinal fibre axis. Preferably, the output surface is spaced by a distance of 0.1 μm to 5 cm from the member of the natural vibration conduction pathway.

The effect of an auditory nerve signal being generated in response to irradiation emitted from a device of the invention, preferably laser irradiation or a comparable light source like for example a light emitting diode (LED), could not be expected from prior art. The first reason is that prior art hearing aids emitting laser irradiation always directly stimulate the auditory nerve. As the auditory nerve is directly stimulated by the irradiation, mechanical vibration is not regarded as the cause for nerve stimulation. The second reason is that the power of the light source in the device of the invention can have a rather low power output, but is still able to generate sufficient mechanical vibration, which in turn elicits an auditory nerve signal within the closed, e.g. undisturbed cochlea. This effect for generating mechanical vibration within the members of the vibration transmission chain from the ear drum to the outer cochlea, e.g. to the round window membrane, the ear drum, without a direct mechanical contact of the laser output surface to the irradiated target site could not be expected from prior art discussions, because prior art either shows that laser irradiation has a damaging effect on hearing, or discusses that the laser irradiation can effect mechanical vibrations due to the local heating caused by the laser irradiation. Due to this heating, laser irradiation can be regarded as having a potentially damaging effect. Further, it can be concluded from the mode of action of a laser to generate local heating that the irradiation requires a sufficient energy output to generate such a thermal effect. Accordingly, it could not be expected that laser irradiation effects mechanical vibrations in members of the natural vibration transmission pathway from the ear drum to the outer cochlea, or that even long-term application of irradiation by a device of the invention generates a hearing impression, without the deteriorating effects shown in prior art, i.e. that the device of the invention is suitable for long-term use as the members of the hearing organ are not destroyed even by long-term use comprising laser irradiation.

Preferably, the device comprises a microphone, a signal transducer, a first coil coupled to the signal transducer for emitting radiation, a second coil spaced from the first coil for receiving radiation from the first coil, a receiver connected to the second coil, a pulsed light source capable of producing pulsed irradiation, a control unit coupled to the light source for controlling and modulating the frequency of pulsed irradiation, and at least one optical fibre optically coupled to the laser for reception of pulsed irradiation produced by the pulsed light source, wherein the pulsed light source and the optical fibre form an optical path terminating in an output surface emitting pulsed irradiation from the end section of the optical fibre opposite the light source, and wherein the optical fibre is dimensioned for termination in the output surface adjacent to and spaced from an at least partially functional element of the natural vibration transduction pathway for transmission of pulsed irradiation from the output surface to the functional element of the natural vibration transduction pathway, which functional element is functionally coupled for transduction of vibration to the cochlea and is selected from the group comprising the skull, the tympanic membrane, the hammer, the incus, the stapes, the outside of the cochlea, the otic capsule, the round window membrane, and the oval window.

In certain embodiments, the device can comprise a microphone, a signal transducer, a first coil coupled to the signal transducer for emitting radiation, a second coil spaced from the first coil for receiving radiation from the first coil, a receiver connected to the second coil, a pulsed light source capable of producing pulsed irradiation, a control unit coupled to the pulsed light source for controlling and modulating the frequency of irradiation, wherein the pulsed light source forms an optical path terminating in an output surface emitting irradiation, and wherein the pulsed light source is dimensioned for termination in the output surface adjacent to and spaced from an at least partially functional element of the natural vibration transduction pathway for transmission of irradiation from the output surface to the functional element of the natural vibration transduction pathway. Generally, the modulation of the irradiation preferably is in response to acoustic signals received by the microphone, and the control unit coupled to the light source modulates the irradiation in response to the signals.

Further, the invention relates to a method for operating the device. Accordingly, the device of the invention preferably is for use in patients having a circumferentially closed cochlea, e.g. a mechanically intact and/or mechanically sealed cochlea which contains cochlear endolymphatic fluid. The device of the invention is for use in patients that have a functional cochlea containing at least a one region of functional sensory cells, e.g. hair cells, which fraction is e.g. a fraction of the natural average sensory cells, e.g. at least 10% to at least 50% functional hair cells. In accordance with the device using a target site outside the cochlea while leaving the cochlea intact, the device of the invention can be used for permanent or temporal arrangement of its output surface adjacent a target site, which avoids the risk of infections and/or of damages to the cochlea associated with intra-cochlear implants or FMT's attached positioned at the round window. Also the infections of transcutaneously positioned bone conduction hearing aids (e.g. bone anchored hearing aids BAHA) as well as their function issues when the bone contact is lost, are avoided by the device of the invention.

The hearing aid device preferably contains a receiver, a transducer of the acoustic signals into electrical current serving as a signal representing the acoustic signal received, a pulsed light source like for example a laser or a comparable light source e.g. a light emitting diode (LED) connected to the transducer for receiving the electrical current and for generating modulated pulsed irradiation in dependence from the electrical current, and preferably one or more optical fibres optically coupled to the exit of the light source, wherein the optical path for conduction of pulsed irradiation within the device ends in an output surface. For emitting energy that induces vibration in a target site to induce auditory nervous signals, the device only contains one or more output surfaces of an optical path. The optical path contains, and preferably consists of, a laser or another pulsed light source which is, optically coupled to the output surface. For the purpose of describing the invention, the term laser is also used to include other light sources than lasers, e.g. light sources emitting non-coherent irradiation, e.g. LEDs. In one embodiment, the output surface is immediately adjacent to the light source, e.g. the output surface is a surface of an optical element like a lens arranged at the laser or another pulsed light source, or it is a surface of the light source itself. In another embodiment, the optical path contains, preferably consists of, a laser or another pulsed light source and one or more optical fibres coupled to the light source with optical elements like lenses optionally arranged between the laser and the optical fibre and/or at the end of the optical fibre opposite the laser, wherein the output surface is the cross-sectional surface of the optical fibre, or of an optical element like a lens arranged at this cross-sectional surface of the optical fibre. Further optionally, the output surface can be provided with an irradiation absorbing material.

Generally, in the invention a laser contains a laser medium and an optical resonator arranged at the laser medium as well as optical elements for forming coherent irradiation, i.e. laser irradiation, e.g. one or more lenses.

In the device of the invention, the optical path for conduction of irradiation within the device terminates at the irradiation output surface, e.g. of the laser or at the output surface of an end section of an optical fibre connected to the laser, optionally with an optical element like a lens arranged at the irradiation output surface of the laser and/or of the end section of the optical fibre. Accordingly, the device of the invention does not contain an element receiving laser irradiation exiting the optical path of the device, and therefore, the output surface directly in front of the functional element target site of the natural hearing pathway, i.e. without any portions of the device arranged between the output surface and the target site.

The device is designed for the optical path to terminate in at least one output surface adjacent a target section, which is selected from one or more sections of the natural hearing apparatus sections which participate in the signal transduction pathway from the tympanic membrane to the outside of the cochlea.

In embodiments of the invention containing an optical fibre coupled to the light source, the path of conduction of pulsed irradiation terminates at the cross-sectional surface of an end section of an optical fibre or at a lens arranged at the cross-sectional surface of the end section, with the output surface optionally covered with an irradiation absorbing material. The optical fibre can be made out of different materials e.g. from the group of glass, plastics or organic materials, e.g. silk. In embodiments containing no optical fibre in the device, the optical path of the device terminates at the output surface of the laser for generating modulated pulsed laser irradiation or a comparable light source like for example a light emitting diode (LED) or at a lens forming or arranged at the exit of the pulsed light source, which output surface is optionally provided with an irradiation absorbing material. The output surface is disposed adjacent a target section, which embodiment allows for direct stimulation of the target site by the pulses generated within the laser or another pulsed light source.

According to the invention, the output surface of one or more laser media or optical fibres coupled to the laser media are dimensioned for arrangement adjacent a target site to transmit a stimulating signal to the outside of the cochlea or to a natural element that transmits vibration signals to the cochlea. The preferred target sites, in relation to which the output surface of a laser or of end sections of the optical fibres are dimensioned for placement in close vicinity and in a distance to avoid mechanical coupling, are selected from the tympanic membrane, one or more bones of the ossicular chain, namely to the hammer, incus and/or stapes, the temporal bone, the skull, and/or the outside of the cochlea, including the intact round window of the cochlea and the intact oval window of the cochlea, and further optionally including mechanically coupled body sections which transmit vibration of the hearing frequency range.

In the invention, essentially the only surface of the device emitting energy for inducing vibration in a target site of the ear is the output surface, which forms the terminus of the energy conducting path within the device, namely the terminus of the optical path that is controlled by the device only.

The invention provides for an alternative to the state of art devices which are designed and disposed to directly transmit vibration to the ear by mechanical coupling of a transducer element which emits vibration signals in response to input signals. The hearing aid device of the invention has one or a plurality of laser media or other pulsed light sources which are optionally coupled to optical fibres for the transduction of stimulating light signals to the output surface of the optical path, e.g. to the end sections of the optical fibres, which are dimensioned for arrangement in a spaced relation and adjacent a portion of the target sites of the natural vibration transduction pathway elements. Due to the dimensioning of the device for positioning of the output surface of its optical path in a spaced relationship from a target site within the natural vibration transduction pathway elements, the device of the invention is not designed nor dimensioned for direct transmittance of vibration signals by direct mechanical coupling e.g. of the fibres to a portion of the natural vibration signal transduction pathway. In the embodiment containing an optical path that consists of a laser or another pulsed light source, optionally provided with an irradiation absorbing material at its output surface, the spacing of the output surface effects a direct excitation of vibration signals at the target site without mechanical coupling. This is also the case in embodiments containing an optical path that consists of a pulsed light source coupled to one or more optical fibres with an optional lens arranged at the end section containing the output surface, wherein the optical fibre is dimensioned for arrangement of its output surface spaced from the target site.

In contrast to state of art devices using rigidly mechanically coupled vibration generators to introduce vibration signals to a structure of the ear, the embodiments of the invention surprisingly demonstrate that pulsed light irradiation conducted to the output surface of an optical path, which output surface is dimensioned for arrangement adjacent and in a spacing from the target site, is sufficient to generate vibration signals within a target site without direct mechanical coupling of the device to the target site. Whereas state of art devices use a transducer which emits acoustic sound vibration with direct attachment of the transducer to a bony structure or to the tympanic membrane, the device of the invention contains an optical path essentially consisting of a pulsed light source, optionally coupled to an optical fibre, that is dimensioned for arrangement of the output surface of the optical path adjacent but not contacting a bony body section that is rigidly fixed and/or mechanically coupled to the cochlea. Accordingly, the invention shows that a device having a laser or another pulsed light source, optionally coupled to an optical fibre, the output surface, e.g. of the end section of which is dimensioned for arrangement adjacent a target site, and not in contact with the target site, effects the generation of auditory nervous signals in dependence on frequency modulated pulsed light irradiation conducted to the output surface of the optical path.

The device and process of the invention have the advantage over state of the art devices which are disposed to transmit vibration signals across a mechanical coupling of a transducer to a target site of the ear in that no direct contact and no direct mechanical coupling of the end section of the optic fibre to a target site is necessary, and should in fact be avoided to reduce undesired pulses and other side effects, e.g. infections, the risk of loss of mechanical coupling, the risk of perforation of anatomical structures like the tympanic membrane, the meninges due to mechanical stress caused by the mechanical contact or positioning procedure. Due to the spacing of the output surface of the optical path from the target site, there is no need for precise placement of a part of the device to a target site, and no need for a mechanical bond between a part of the device and a target site. Accordingly, the device and process of the invention allow for a simple localisation of the output surface of the optical path, e.g. of the output surface of the pulsed light source or of the end section of the optic fibre adjacent a target site without requirement for mechanical contact, and in addition avoid a change of the vibration characteristics of the target site and of the hearing perception, because no mechanical bond is made, and because no weight is added to an element of the natural vibration transduction pathway.

In the description of the invention, the term output surface can comprise an irradiation absorbing material attached, e.g. coated onto the output surface, e.g. when the optional presence of the irradiation absorbing material is not explicitly mentioned.

In accordance with the disposition and dimensioning of the output surface of the optical path, e.g. of the output surface of the light source or of the end sections of optical fibres coupled to the light source, for arrangement of the output surface in a spaced relationship to the outside of the cochlea and/or in a spaced relationship from an element of the natural vibration signal transduction pathway, the invention is for use in humans having an at least partially functional cochlea, e.g. excluding humans with complete bilateral sensorineural deafness. For example, the device of the invention is suitable for application/implantation into patients with impaired transmission of sound vibration signals to the cochlea, e.g. due to obstruction or damage of the outer ear canal, middle ear and/or due to damage to an element of the natural mechanical vibration signal transduction pathway, e.g. for patients suffering from conductive hearing loss, outer and middle ear malformations, unilateral deafness, mild sensorineural hearing loss and other causes.

In the intact ear, the organ of Corti within the cochlea generates nervous signals in response to mechanical stimuli, which nervous signals are passed to the auditory neurons. The device of the invention contains an arrangement of the output surface of a light source or of an optical fibre, which light source or optical fibre have a length that is pre-determined for arrangement of their output surface, adjacent to but not contacting a target site, e.g. the outside of the cochlea, the intact round window membrane or a mechanically coupled natural element of the vibration transduction pathway. In detail, the light source and/or the optical fibres coupled to the laser are dimensioned to terminate in output surfaces, e.g. in end sections, which are in the very next vicinity but not contacting the target site outside the cochlea, or the outside of the cochlea. Consequently, an output surface of the light source and of an optical fibre in embodiments containing an optical fibre coupled to the laser or another pulsed light source is dimensioned for receiving pulsed irradiation adjacent a pre-determined target site, which irradiation is modulated in accordance with a sound. Following arrangement of the laser or another pulsed light source and/or of optical fibres coupled to the light source, which arrangement can include implantation, the output surface of the light source or of the optical fibres of the device/are localized adjacent the cochlea and/or adjacent another target site according to the invention in a spaced relation and without direct mechanical contact, for evoking a nervous signal within the cochlea by delivering pulsed light to the output surface, e.g. to end sections of the optical fibres. The transmittance of pulsed light irradiation to the output surface terminating the optical path within the device induces mechanical stimuli in the target sites, which mechanical stimuli after transmission to the organ of Corti within the cochlea generate nervous signals which are then transmitted to the auditory nerve. Subsequently, the auditory nerve transmits the nervous signals to the brain, where the nervous signals generate a sound perception.

Due to the optical path of the device being dimensioned to terminate in at least one output surface, e.g. in the output surface of the laser or in the output surface of an end section of an optical fibre coupled to the laser or another pulsed light source, adjacent to but not directly contacting their target sites, the device of the invention in general is adapted to avoid direct mechanical stimulation of the cochlea or of elements of the natural vibration transduction pathway that are mechanically linked to the cochlea. As a consequence of the spacing of the output surface of the optical path from the target site, no mechanical load is imparted from the device to the target site, reducing interfering mechanical stimuli. For converting sound into a modulated pulsed light irradiation, the laser or another pulsed light source is preferably controlled by a modulator to generate irradiation specific for a pre-determined range of sound-frequencies. Optionally, the modulator can be equipped to modulate the pulse energy and/or the wavelength of the irradiation, e.g. in addition or in alternative to modulate the frequency of the irradiation, in response to acoustic signals received by a receiver. Accordingly, the device and a method for operating the device can comprise a modulator equipped for modulation of the frequency, the energy, e.g. pulse energy, pulse duration, and/or the interval between pulses, and/or the wavelength of the irradiation, and the modulation of the frequency, the energy, e.g. the pulse energy, pulse duration, and/or the interval between pulses, and/or the wavelength of the irradiation, respectively.

Preferably, the output surfaces of the optical path, e.g. the output surface of the light source or of an end section of an optical fibre are dimensioned for arrangement in a spaced relationship to a target site to avoid contact to the target site and to allow stimulation of the target site in response to irradiation conducted to the output surface. The spaced relationship preferably is the arrangement of the output surface to the target site in a distance in a range essentially from about 1 μm to 5 cm, preferably in a range essentially from about 1 μM to 10 mm, more preferably in a range essentially from 10 μm or 50 μm to 1 mm.

It has been found that the target sites according to the invention are excited to elicit vibration signals in dependence on modulated pulsed light irradiation transmitted to an output surface of the optical path of the device, e.g. to the output surface of the light source, e.g. of the laser, or to the end section of an optical fibre coupled to the light source, preferably to a laser effectively at power levels below 50 μW, preferably at 1 Hz and more preferably at 10 ns pulses. This finding contrasts the basic considerations of Fridberger and Ren, because the energy levels of the pulsed laser irradiation emitted by the laser and transmitted to the end sections of the fibres are below the energy required according to Fridberger and Ren as calculated by the values of 50 μs pulses of a 1.3 W laser diode with 500 ms pauses for exerting sufficient force, e.g. by direct irradiation onto the organ of Corti.

Further, it has been found that excitation of target sites by a device or a process according to the invention is also obtained by conduction of modulated pulsed light irradiation in the optical path to an output surface, wherein the output surface and optionally the absorbing material at the output surface, terminate the optical path within the device. E.g., excitation of target sites is obtained by conduction of the pulsed irradiation to the end sections of the optical fibres in an embodiment of the fibres having their end sections provided with an irradiation absorbing material.

The output surface terminating the optical path, e.g. the output surface of the laser or the end section of an optical fibre can be provided with a lens. Preferably, the circumferential surface of an optical fibre is covered by a material having reduced transmission for reducing the emittance of irradiation from the fibre other than through its output surface at a cross-sectional surface opposite the laser. For instance, a material with reduced transmission properties can be applied by coating or a coating with a material having reduced transmission properties can be generated by etching of the circumferential surface of the optical fibre. The material having reduced transmission properties can be selected from a metal or metal oxide, e.g. selected from the group consisting of gold, silver, platinum, titanium or oxides thereof, or a plastic material, e.g. selected from the group consisting of polymers.

In accordance with the light source or optical fibres transmitting irradiation to their output surfaces adjacent target sites which are functional elements of the natural vibration conduction pathway, and which element is coupled for transduction of vibration signals to the cochlea, the end section of the fibres that are arranged within the ear, e.g. within the ear canal or implantable adjacent an ossicle of the ossicular chain, or adjacent the cochlea, can also be referred to as an opto-mechanical hearing stimulator.

In one embodiment, the optical path within the device comprising a laser or another pulsed light source is confined to the laser or another pulsed light source with an optional optical element like a lens, the optical path terminating in the output surface of the laser or another pulsed light source or in the output surface of the optical element. In this embodiment, the laser, optionally including an optical element like a lens, is dimensioned for arrangement of its output surface adjacent a target site.

In another embodiment, the device contains an optical path including the laser or another pulsed light source and one or more optical fibres coupled to the output surface of the light source, optionally containing optical elements like lenses arranged between the laser and the optical fibre, and/or at the end section of the optical fibre opposite the laser. In this embodiment, each optical fibre is dimensioned for arrangement of its output surface, i.e. of its cross-section at its end section, optionally including a lens, adjacent a target site.

Preferably, the optical fibres of this embodiment are essentially parallel to one another, and more preferably, the optical fibres are attached to one another. For attachment of the optical fibres, they can be partially embedded in a biocompatible elastic material, e.g. silicone.

Preferably, the optical fibres have a non-transparent circumferential outer surface, e.g. provided by a non-transparent coating or a non-transparent radial surface structure. The non-transparent radial outer surface of optical fibres can e.g. be provided by a coating of a material having a diffraction index differing from the diffraction index of the material of which the optical fibres consist, for example a glass coating of a glass having a higher or lower diffraction index than glass of the optical fibre. Another example of such a coating is a metal or metal oxide coating, e.g. comprising or consisting of gold, titanium, silver, titanium dioxide and/or silver oxide. The cross-sectional fibre surface, which is preferably perpendicular to the longitudinal axis of the fibre at the end of the fibre which is dimensioned for arrangement adjacent to the target site, can be optically transparent, and optionally it has reduced transparency, e.g. a coating by a material of reduced optical transparency or a non-transparent material. This embodiment has been found to effectively generate mechanical vibration at the target site by irradiation exiting the output surface at the end section of the fibre.

The output surface of the optical path, e.g. the cross-sectional surface of the end section of the optical fibre, preferably is in an angle of 0° to 90°, to the longitudinal axis of the optical path, e.g. to the optical fibre, so that the irradiation transmitted along the optical path can exit the output surface or can be reflected by the output surface and irradiate in an angle to the axis of the optical path, e.g. between 0° and 120°. It has been found in animal experiments that laser irradiation transmitted to the end sections of the optical fibres adjacent target sites according to the invention, e.g. to the tympanic membrane, members of the ossicular chain, or to the outside of the cochlea, e.g. to the window membrane, elicits auditory brainstem responses (ABR) for laser energy levels in the range of 1-300/pulse. Prolonged exposure of these target sites to the pulsed irradiation emitted from the device of the invention did not produce significant cellular damage but resulted in the generation of ABR in accordance with irradiation, and essentially without loss of ABR amplitudes over extended periods of time, indicating that the device of the invention is suitable for long-term use as a hearing aid device. From the animal experiments it can be deduced that for induction of vibration signals in target sites of the invention it is preferred that the laser and the optical fibres are set to emit a maximum laser pulse energy in the range of about 1 nJ to 1 mJ, preferably in the range of about 1 nJ to 50 μJ, e.g. at a pulse frequency of 1 Hz to 10 MHz, e.g. at pulse durations in the range of about 1 fs to 1 ms, preferably to 1 μs, preferably in the range of 1 fs to 1 ns. Due to the spatial confinement of irradiation conducted to the end sections of the optical fibres, and due to the dimensioning of the optical fibres for their positioning adjacent pre-determined target sites according to the invention, the device of the invention has the advantage of combining the excitation of the target site in accordance with the modulation of the irradiation, and hence of frequency-specific excitation of the auditory nerve, with a tolerable burden on the target sites, i.e. a non-destructive excitation of mechanically coupled elements of the vibration signal transduction pathway, allowing for frequency specific cochlear stimulation and for its long-term use.

Without wishing to be bound by theory, it is at present presumed that the excitation of the target sites of the invention that is effected by pulsed irradiation guided to the end sections of optical fibres that are dimensioned for arrangement adjacent to the target sites is caused by mechanical pulses generated by the irradiation pulses, rather than by direct effects of incident irradiation on the sensory cells.

In the practice of the invention, the optical fibres, preferably including the laser or another pulsed light source, are dimensioned for permanently positioning their end sections adjacent to the target site in the case of target sites within the middle ear, and preferably by arrangement of the optical fibres with their end sections adjacent one of the members of the ossicular chain, or adjacent the cochlea, e.g. directed towards its round window membrane or its oval window membrane. In embodiments suitable for humans having a functional, optionally an impaired functional vibration transduction chain comprising the tympanic membrane, the ossicular chain and the cochlea, the optical fibres can be dimensioned for arrangement along the ear canal with one or more end sections adjacent the tympanic membrane, for permanent implantation or for removable positioning, e.g. for transient arrangement along the ear canal into a spaced localisation of the output surfaces of the optical path at end sections of the fibres adjacent the tympanic membrane. The latter embodiment is preferred for a hearing aid device.

Preferably, optical fibres are of circular cross-section with a core diameter of up to 200 μm, more preferably with a core diameter smaller than 30 μm.

For generating laser irradiation in response to input signals, preferably in response to sound, the device in addition to the optical fibres comprises a laser connected to the optical fibres for generation of laser irradiation and coupling the laser irradiation into the optical fibres. Preferably, the laser is coupled and connected to the optical fibres in a distance to the end sections of the optical fibres, e.g. at an end opposite the end sections dimensioned for arrangement adjacent a target site of the invention.

The optical fibres can each be coupled with an individual laser or another pulsed light source, or an optical switch can be arranged between one or more laser media or light source and two or more optical fibres. Embodiments comprising an optical switch preferably have one or more light sources coupled to an input side of the optical switch and two or more optical fibres coupled to an output side of the optical switch.

Further, the device optionally comprises an optical modulator for modulating the irradiation, which optical modulator can e.g. be arranged between the laser and an optical fibre, and in the presence of an optical switch, the optical modulator can be arranged between the light source and the input side of the optical switch, or preferably between the output side of the optical switch and an optical fibre.

The laser or another pulsed light source preferably has an average power output at or below about 100 mW, more preferably of about 1 μW, measured at a frequency of 1 Hz-100 MHz Suitably, the laser emits at a wavelength of 200 nm to 5000 nm, more preferably at a wavelength of 300 nm to 3000 nm, more preferably at 400 nm to 600 nm, most preferably below 550 nm or below 500 nm, e.g. between a lower range of 200 to 300 nm and an upper range of 550 to 500 nm. The laser emits irradiation with a pulse length in the range of about 1 fs to 1 ms, preferably in the range up to 1 ms, more preferably in the range of 1 ps to 1 ns. For optimum signal generation the so-called stress-confinement has to be fulfilled, which means that the laser pulse duration has to be short compared to the time the acoustic signal needs to propagate through the optical penetration depth at the speed of sound:

$$\tau_L \cdot \mu_a \cdot c_0 \ll 1$$

wherein $\tau_L$ is the pulse duration of a single pulse, $\mu_a$ is the optical absorption coefficient of the irradiated material, and $c_0$ is the local speed of sound. In this case, no energy dissipation will occur during generation of the acoustic signal. An exemplary laser is a 532 nm Nd:YAG laser (obtainable from Quantel Brilliant BW, France), set at 10 ns pulses at a frequency of 10 Hz, e.g. controlled to emit up to 30 μJ/pulse for an average of 500 pulses. Most preferably, especially in embodiments with the end sections of the optical fibres being uncoated, i.e. having no absorption material attached, the device is set to a laser pulse duration shorter than the duration of the transit of an acoustic wave across the irradiated volume. For the limitation of the laser pulse duration to a value smaller than the duration of the transit of an acoustic wave across the irradiated volume, the components of the device preferably are pre-set, e.g. the controller unit controlling the laser, the laser, the optional optical switch, and the optional optical modulator are controlled, e.g. by the controller unit, to limit the laser pulse duration to a preset value. Preferred values for laser pulse duration are in the range of 1 fs-1 msec, preferably 1 ns-1 μsec, more preferably of up to 20 or up to 10 ns, preferably in combination with a maximum pulse energy of 50 μJ, more preferably of about up to 13 to 24 μJ.

It can be seen from animal experiments that the device of the invention allows the stimulation of the target sites of the elements of the vibration conduction pathway, especially of the tympanic membrane, the elements of the ossicular chain between the tympanic membrane and the outside of the cochlea, and the outside surface of the cochlea, as exemplified by the intact round window of the cochlea, the pars tensa of the tympanic membrane, the otic capsule, the mastoid at a distance from the round window membrane, and the hammer. In detail, it is shown that acoustic nerve signals are generated within the colliculus inferior of experimental animals upon pulsed irradiation of the target sites of the invention, which nerve signals have an intensity corresponding to the modulation of the irradiation.

Preferably, pulsed mode of operation lasers are used, e.g. Q-switched laser, a laser diode, or a light emitting diode (LED).

For controlling the irradiation, the laser or another pulsed light source is connected to a control unit which activates the laser to emit pulsed irradiation which is modulated in response to frequency signals received by the control unit. The frequency signals preferably are generated in response to sound received by a receiver containing a sound-dependent frequency signal generator. The receiver can be an acoustic receiver or a receiver of radio frequency waves, and the output of the receiver is preferably coupled to the control unit.

The invention also relates to a process for evocation of ABR in a human by imparting pulses to the cochlea as described in relation to the device. The process includes the steps of generating pulsed light irradiation in a laser or a comparable light source like for example a light emitting diode (LED), which pulsed light irradiation preferably is also frequency-modulated in dependency of a sound-signal, transmitting the laser irradiation to an element of the natural vibration transduction pathway, e.g. to the tympanic membrane, a member of the ossicular chain, or to the outside of the cochlea, e.g. to the window membrane, by an optical path of the device terminating in an output surface adjacent to an element of the natural vibration transduction pathway. The output surface can be provided by the output surface of a laser or by one or multiple optical fibres which are coupled to the laser. For arranging the output surface adjacent the target site on an element of the natural vibration transduction pathway, the laser or the optical fibre coupled to it is dimensioned and arranged with its end section adjacent the target site. The process can be performed for extended periods of time, allowing the generation of nervous signals in cochlea, and hence the generation of sound perception in the brain of the cochlear stimulator recipient. Process parameters are as described with reference to the device, and preferably, the process is performed by the device as described herein.

DETAILED DESCRIPTION OF THE INVENTION

Figure 2:
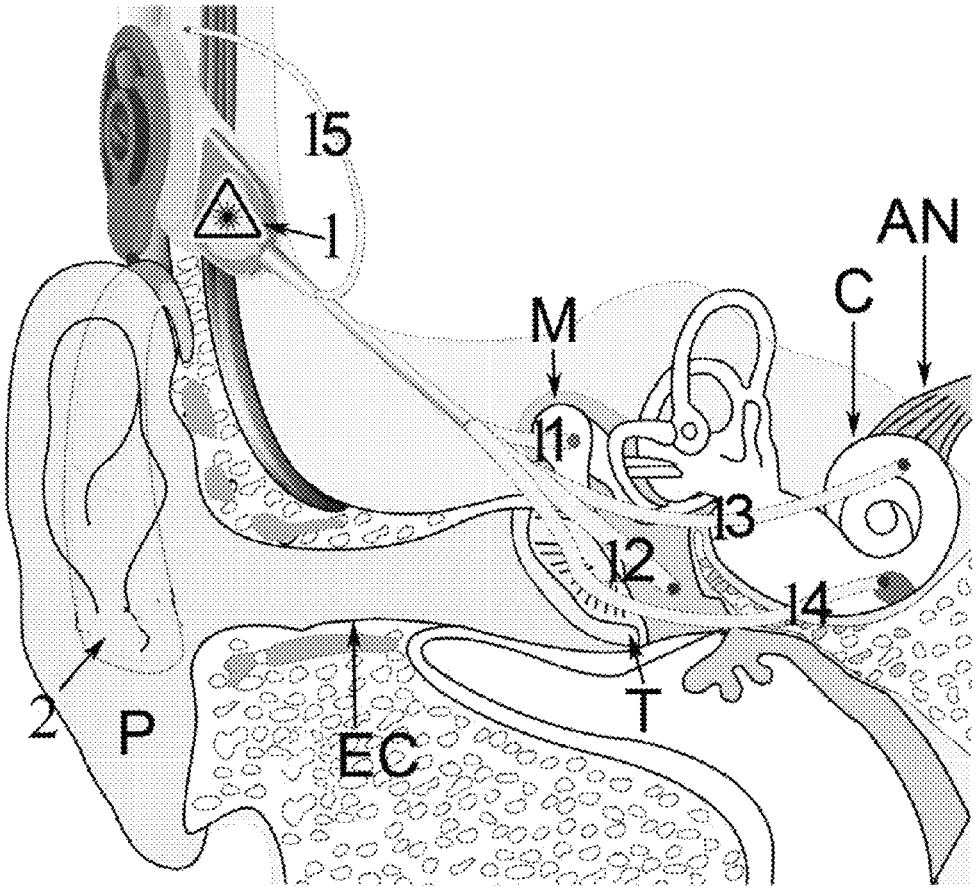
Figure 3:
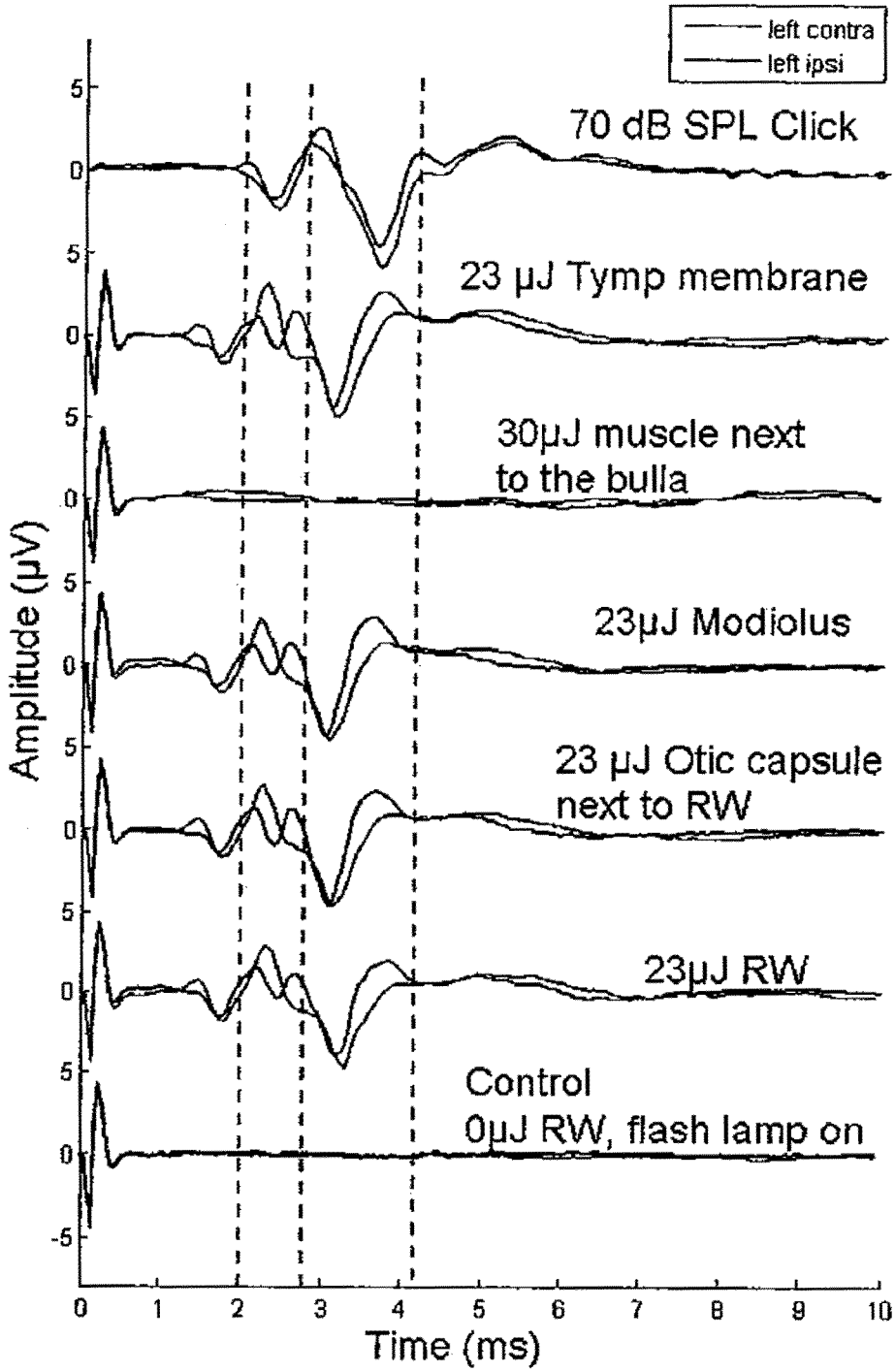

The invention is now described in greater detail by way of example and with reference to the figures, wherein FIG. 1 schematically shows a preferred embodiment of the hearing aid device for arrangement within external portions of the ear, FIG. 2 schematically shows an overview of embodiments of the hearing aid device for permanent implantation of end sections of the optical fibres into portions of the middle ear, otic capsule, scull, FIG. 3 shows auditory brainstem response (ABR) measurement results in hearing animals upon stimulation.

Figure 4:
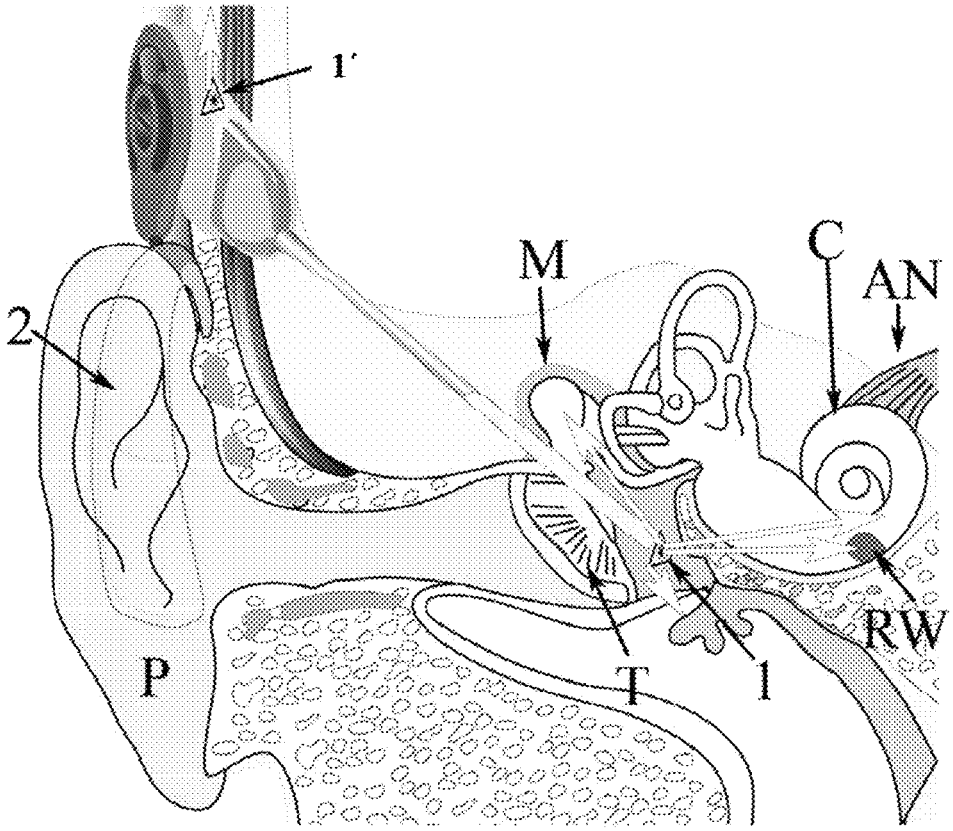
Figure 5:
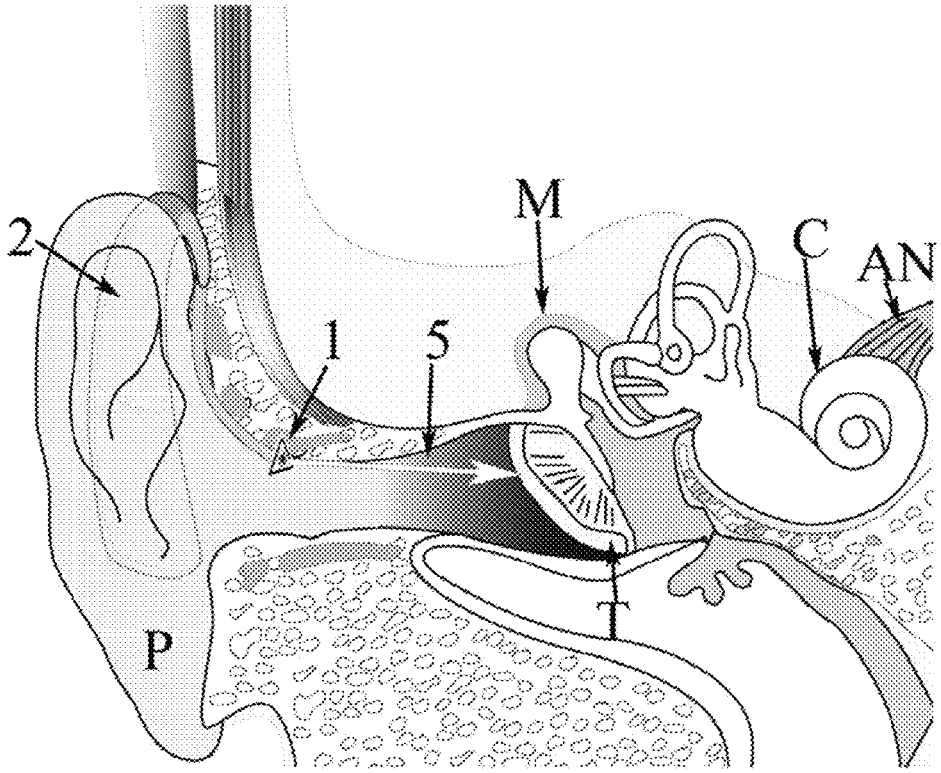
Figure 6:
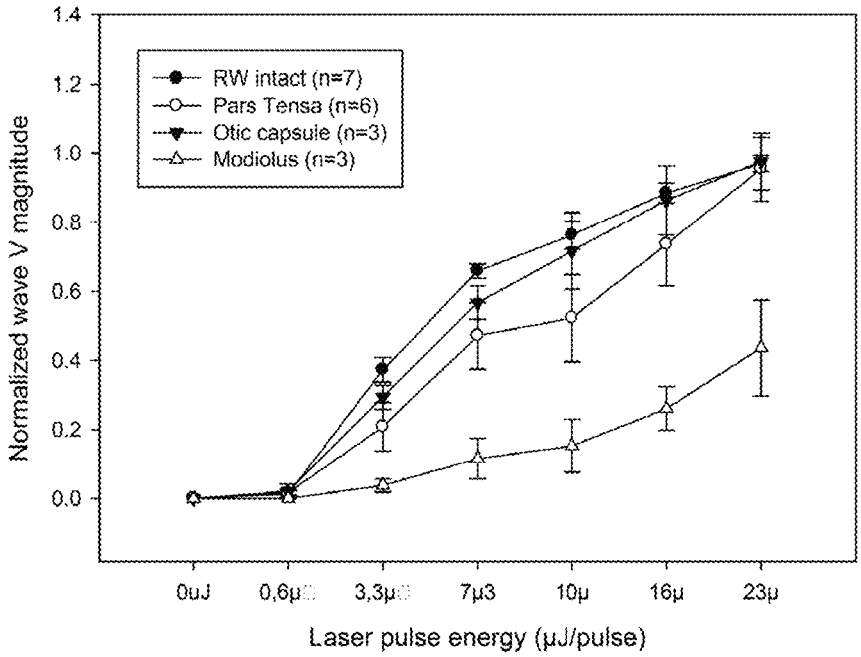
Figure 7:
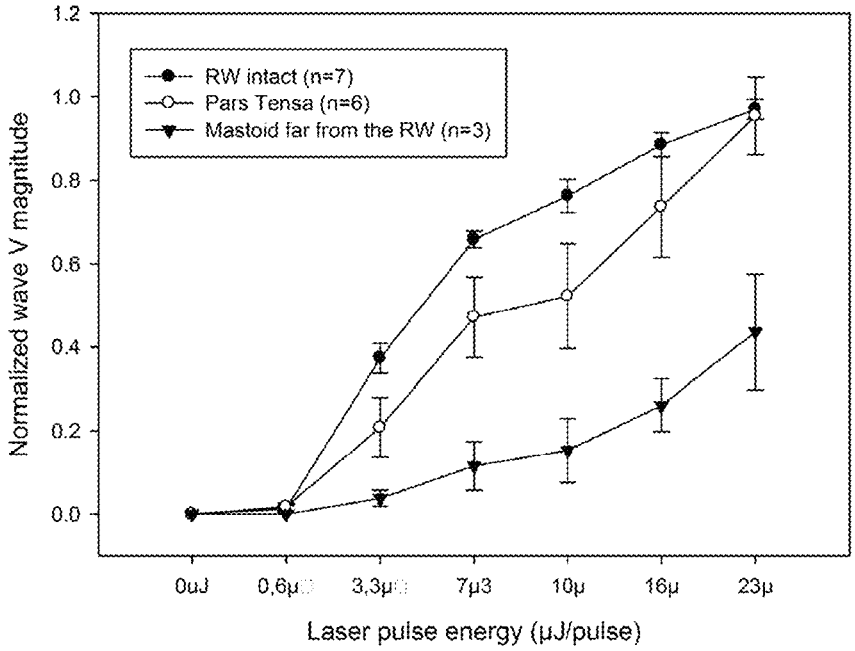

FIG. 4 schematically shows a preferred embodiment of the hearing aid device for arrangement within external portions of the ear and with direct application of the laser beam from the laser medium to the tympanic membrane, FIG. 5 schematically shows an overview of embodiments of the hearing aid device for permanent implantation with direct application of the laser beam from the laser medium into portions of the middle ear, otic capsule, scull, and FIGS. 6 and 7 show recordings of the auditory nerve signals elicited by a device of the invention directed to different elements of the auditory vibration conduction pathway.

In FIGS. 1, 2, 4 and 5, identical reference signs denote functionally identical parts.

A preferred embodiment of the hearing aid device of the invention is depicted in FIG. 1 in an arrangement within the outer portions of a human ear for performing a process of the invention. The laser 1 is controlled by a modulator 2, which preferably controls the laser 1 to generate pulsed laser irradiation or a comparable light source like for example a light emitting diode (LED), which is frequency modulated in dependence on signals, which preferably represent acoustic signals, received by the modulator 2, e.g. by a receiver section of modulator 2. The modulator 2 can e.g. be worn by attachment to the pinna P as shown. The exit of laser 1 or other pulsed light source is coupled to one or more optical fibres 3 which conduct the modulated pulsed laser irradiation emitted from the laser 1 or a comparable light source like for example a light emitting diode (LED).

End section 4 of optical fibre 3 is arranged adjacent but not contacting a target site, in this embodiment adjacent the tympanic membrane T, which is a the membrane connecting the outer ear canal to the middle ear M that is accessible from the outer ear canal EC without invading the middle ear M or the inner ear. This embodiment of the device, wherein an optical fibre 3 is dimensioned for arrangement along the ear canal and arrangement of its end section 4 adjacent the tympanic membrane T has the advantage of accessing the target site through a portion of the ear which is accessible from the outside, i.e. without requiring implantation. Adding to this is the advantage of the function of the device being independent from a mechanical coupling to the target site.

FIG. 1 schematically depicts a signal cone 5 exiting the end section 4 of optical fibre 3. Signal cone 5 is generated by laser irradiation conducted along optical fibre 3 to its end section 4. Depending on the optical characteristics of the optical fibre 3 and of its end section 4, the signal cone 5 can comprise photon-irradiation and through this a pressure wave in the stress confinement regime and is assumed to be produced by the frequency modulated pulsed laser irradiation or a comparable light source like for example a light emitting diode (LED), conducted by the optical fibre 3 to its end section 4. In embodiments in which the end section 4 is provided with an irradiation absorbing material at least on the cross-sectional surface of the end section 4 of the optical fibre 3, the signal cone 5 predominantly contains the energy emitted from the absorbing material, e.g. pressure waves or irradiation, e.g. of a longer wavelength than the laser irradiation conducted along optical fibre 3. Accordingly, the optical fibre 3 is preferably dimensioned for arrangement of its end section 4 adjacent the target site by a spacing that avoids contact to the target site and allows for the laser irradiation or other light source irradiation, conducted to the end section 4 to generate a signal cone 5 acting on the target site, e.g. an effective bridging of the spacing by signal cone 5.

In the device and in the process of the invention, the laser 1 or a comparable light source like for example a light emitting diode (LED), is controlled by modulator 2 for the generation of pulsed light irradiation which is frequency modulated in response to signals, e.g. representing acoustic signals received by the modulator 2. The laser irradiation is conducted along optical fibre 3 which is optically coupled to laser 1, to the end section 4 of the optical fibre 3. Optical fibre 3 is dimensioned to connect laser or other light source 1 to the end section 4 in an arrangement adjacent the target site. In this embodiment, optical fibre 3 is disposed within the outer ear canal to end in an end section 4 that is arranged adjacent the outer surface of tympanic membrane T with a spacing. At the end section 4, a signal cone 5 is generated by the light irradiation, which signal cone 5 bridges the spacing between the end section 4 and the target site. As a consequence of signal cone 5 bridging the spacing between the end section 4 and the target site, signal cone 5 impinges upon the target site and elicits a vibration signal which is transmitted by the tympanic membrane T and by means of the ossicular chain to the cochlea to cause a nervous auditory signal in the auditory nerve (AN).

FIG. 2 shows an overview of a device of the invention in which optical fibres 3 are dimensioned for alternative or concurrent arrangement adjacent more than one target site of the middle ear M or of the inner ear. In these embodiments, it is preferred that the laser 1 or a comparable light source, a modulator 2, and optical fibres are disposed and designed for permanent implantation into a body region adjacent the ear. The laser 1 or a comparable light source is coupled to a modulator 2 containing a receiver section, which modulator 2 controls laser 1 or a comparable light source to generate pulsed light irradiation with frequency modulation in dependence on signals received by its receiver section. The signals preferably represent acoustic signals. The modulator 2 preferably is designed for permanent implantation under the skin of a human. The signals can be generated by an external sender that is e.g. part of an external transducer LHA which controls the signals in dependence on acoustic signals. The external transducer LHA can be attached to the pinna P.

The end section 4 of optical fibre 3 is shown to be dimensioned for arrangement adjacent a variety of target sites, which can be selected from a position 11 adjacent a member of the ossicular chain, a position 12 adjacent the temporal bone, a position 13 adjacent the otic capsule that is a bony cover of the cochlea, a position 14 adjacent the intact round window membrane, and a position 15 adjacent the scull.

In the embodiments depicted in FIG. 2, optical fibre 3 is dimensioned for arrangement of the end section 4 adjacent a bony body section that is rigidly fixed and/or mechanically coupled to the cochlea. It has been found that laser irradiation conducted to the end section 4 of the optical fibre 3 evokes auditory nervous signals, which e.g. in an experimental animal can be measured as ABR. Currently, it is assumed that the irradiation conducted to the end section 4 of the optical fibre 3 by means of bridging the spacing between the end section 4 and the target site generates a vibration signal in its target site, and that the vibration signal is transmitted to the cochlea, where it is transformed to an auditory nervous signal.

Measurement results for ABR induced by acoustic stimulation (A-ABR) for comparison and ABR induced by direct irradiation of target sites of the ear (optically induced ABR, O-ABR) using the device in accordance with the embodiment as depicted in FIGS. 1 and 2 are shown in FIG. 3.

FIGS. 4 and 5 schematically show the device of the invention in embodiments, in which the optical path contains no optical fibre, i.e. the optical path essentially consists of the laser 1 or laser 1', i.e. the laser in alternative positions, and the output surface of the device formed by the laser; e.g. by a surface of an optical element of the laser like a mirror or a lens. The irradiation emitted from the output surface of a laser 1 or of a laser 1' in accordance with the positioning of the output surface directly opposite the target site of the natural hearing pathway is directed onto the target site, i.e. without an intermediate portion of the device being arranged between the target site and the output surface.

FIG. 4 shows the irradiation emitted from the output surface of laser 1 by arrows indicating the direction of the irradiation onto the ossicular chain of the middle ear M (upper arrow), and the alternative of directing irradiation directly onto the cochlea C or onto the otic capsule (upper right hand arrow), or onto the round window membrane RW (lower right hand arrow), temporal bone (lower arrow) as examples of target sites. The laser positioning shown at laser 1' is preferred for arranging the laser with its output surface directly facing the skull as indicated by the upward arrow at 1'.

FIG. 5 shows a preferred embodiment of a device containing an optical path essentially consisting of the laser, wherein the output surface of the laser 1 is dimensioned for termination directly opposite the tympanic membrane T for orienting the signal cone 5, i.e. the laser irradiation emitted from the output surface, directly onto the tympanic membrane T. Especially in this embodiment, the spacing of the output surface from the tympanic membrane T can be in the range of 0.1 to 10 mm up to 5 cm.

EXAMPLE

Generation of Sound Perception by Pulsed Laser Irradiation Transmitted into Optic Fibre Terminating Adjacent Tympanic Membrane, Bone Connected to Cochlea, Cochlea, and Intact Round Window Membrane in an Animal Model 8 pigmented guinea pigs (Charles River Laboratories, Solingen, Germany) of either sex (300 to 600 g) were used according to the guidelines of the Animal Care and Use Committee of the Medical University of Hannover and Lower Saxony. Animals were initially anesthetized with 40 mg/kg of ketamine (Ketanest, Albrecht, Aulendorf/Württemberg, Germany) and 10 mg/kg xylazine (Rompun, Bayer Health Care, Leverkusen, Germany), and maintained with ¼-½ of the initial dosage every 30-60 minutes to maintain an areflexive state. Further administered were 0.05 mg/kg of the anticholinergic agent Robinul (Riemser Arzneimittel, Greifswald-Insel Riems, Germany) intramuscularly, 5 mg/kg of the analgesic Rimadyl (Pfizer, Karlsruhe, Germany) and 13 ml/kg Ringer solution subcutaneously. Throughout the experiment the body temperature was maintained at 38° C. using a water heating pad.

For stimulation, a 532 nm Nd:YAG laser (Quantel Brilliant BW, France) was used that delivers 10 ns pulses with a repetition rate of 10 Hz. Optically-induced auditory brainstem responses (O-ABRs) were recorded to varying energy levels (radiant exposure 0-23 μJ/pulse, 500 repetitions/average) and compared them to acoustically-driven auditory brainstem responses (A-ABRs) recorded preoperatively. Both acoustically induced and optically induced ABRs are shown in FIG. 3.

The acoustic stimuli were delivered monaurally through polyurethane foam ear tips connected via plastic tubes to calibrated transducers (TIP-300 Tubal Insert Phone, Nicolet Biomedical Inc., Wisconsin, USA.). Since the A-ABRs were initially used to confirm normal hearing thresholds in the animals, varying levels from 10-90 dB SPL in 10 dB steps for clicks (100 μs duration, alternating polarity) were used for stimulation. The contralateral (right) ear was masked with white noise at 30 dB below stimulus level for the left ear. All recordings were obtained in an electrically shielded and sound attenuated chamber using the Nicolet Viking IV® system (Nicolet Biomedical Inc.). Subdermal needle electrodes (Subdermal EMG Needle Electrodes, 12 mm, Medtronic Xomed, Jacksonville, Fla. USA.) were placed at the vertex (reference), right and left mastoids (signals), and in the neck muscles (ground). Each recorded signal was filtered between 300 and 3000 Hz and averaged across 500 trials. The threshold was defined as the lowest stimulus level that generated a visually detectable waveform. For acoustic stimulation, thresholds were considered normal if they were below 40 dB SPL for click stimuli.

Initially, normal hearing was established in the animals with click-stimulation.

As a negative control, an optic fibre was positioned with its end section adjacent the muscle fibres surrounding the bulla after skin incision and exposure of the bulla surrounding muscles. Upon laser irradiation, no OABR were detected.

For stimulation according to the invention, the optical fibre was positioned into the outer ear canal with its end section adjacent and pointing towards the pars tensa of the left ear drum. Upon laser irradiation of up to 23 μJ, OABR were recorded (FIG. 3).

In accordance with the invention, the optical fibre was placed with its end section adjacent and oriented towards the bony wall covering the outgoing axons of the spiral ganglion, underneath the basal turn of the cochlea. OABR of the classic Jewett shape were recorded upon laser irradiation. The bony wall covering the outgoing axons is mechanically connected to the cochlea and therefore represents a target site in accordance with the invention that is connected with the cochlea for transduction of vibration (FIG. 3).

Further in accordance with the invention, the optical fibre was placed with its end section adjacent the cochlea, at about 500 μm from the bony edge of the round window. Again, OABR of the classic Jewett shape were recorded upon laser irradiation.

Further, the optical fibre was placed with its end section adjacent the intact round window membrane. Again, OABR of the classic Jewett shape were recorded upon laser irradiation.

When the optical fibre was placed with its end section adjacent the intact round window membrane, a further negative control experiment was made with laser energy at 0 μJ but with Q-switch on and flash lamp on. No OABR were recorded in this set-up, demonstrating that the OABR of Jewett shape that were recorded when positioning the end section of the optical fibre adjacent an element of a functional vibration transduction pathway, were induced by the laser irradiation guided to the end section of the optical fibre, and not by electromagnetic or noise effects.

The results are shown in FIG. 3 for the left contra and left ipsi, respectively, with the time in ms on the X-axis for hearing animals for 70 dB click sound signal applied (70 dB SPL click), 23 μJ laser pulses applied to an optical fibre arranged with its end section adjacent the tympanic membrane (23 μJ Tymp membrane), the optical fibre arranged with its end section adjacent the muscle surrounding the bulla (control, 30 μJ muscle next to the bulla), the optical fibre arranged with its end section adjacent the outside of the modiolus (23 μJ Modiolus), the optical fibre arranged with its end section adjacent the otic capsule adjacent the round window (23 μJ Otic capsule next to RW), the optical fibre arranged with its end section adjacent the intact round window membrane (23 μJ RW), and for control, the optical fibre arranged with its end section adjacent the round window membrane without laser irradiation but with flash light coupled into the optical fibre. All O-ABRs exhibited the classical Jewett wave shape obtained from acoustic stimulation except for a shorter latency of about 0.8 μs.

Further, no O-ABRs were elicited when stimulating the soft tissue (muscle) surrounding the bulla (30 μJ muscle next to the bulla), indicating that the activity is not induced by a laser induced artifact in close proximity to the cochlea.

The experiments were repeated with a larger number of animals (n) as indicated in FIGS. 6 and 7 with modulation of the laser-pulse energy. FIG. 6 shows the results of using a device of the invention, in which an optical fibre that was coupled to the laser was dimensioned to terminate in a distance to the pars tensa section of the tympanic membrane, the round window (RW), or to the otic capsule. The cochlea was intact. For comparison, following the irradiation of the members of the vibration conduction pathway including the tympanic membrane to the intact round window membrane with the cochlea being intact, the optical fibre was inserted into the cochlea for comparative measurements with irradiation of the organ of Corti as well as the lamina soiralis osseae. The results show that the device is suitable for evoking neural signals representing a hearing impression by irradiating members of the natural vibration conduction pathway by laser irradiation, and further show that the nerve signals are modulated in accordance with the modulation of the laser irradiation, as exemplified by the modulation of the laser-pulse energy. Therefore, the invention can use the modulation of the intensity and/or frequency of the irradiation for evoking a modulated nerve signal in addition or in the alternative to modulation of the frequency of irradiation.

FIG. 7 confirms the observations of FIG. 6 for a device having an output surface arranged in a distance from the mastoid at a distance from the round window. In comparison to the measurement results for the irradiation of the round window and the pars tensa, it can be seen that the output surface arranged adjacent to the mastoid for directing irradiation onto the mastoid is suitable for eliciting auditory nerve signals from the middle ear walle, but at a lower efficacy.

The invention claimed is:

1. A hearing aid device for a hearing impaired human having an at least partially functional cochlea, the device comprising a pulsed light source capable of producing pulsed irradiation of a wavelength of 200 nm to 1500 nm at pulse duration of fs to 1 μs, a control unit coupled to the pulsed light source for controlling and modulating the frequency of pulsed irradiation to produce the irradiation of a wavelength of 200 nm to 1500 nm at pulse duration of fs to 1 μs, and at least one optical fibre optically coupled to the pulsed light source for reception of pulsed irradiation produced by the pulsed light source, wherein the pulsed light source and the optical fibre form an optical path terminating in an output surface adapted to emit pulsed irradiation from the end section of the optical fibre opposite the pulsed light source, and wherein the optical fibre is dimensioned for termination in the output surface adjacent to and spaced from an at least partially functional element of the natural vibration transduction pathway for transmission of irradiation from the output surface to the functional element of the natural vibration transduction pathway, which functional element is functionally coupled for transduction of vibration to the cochlea and is selected from the group comprising the skull, the tympanic membrane, the hammer, the incus, the stapes, the outside of the cochlea, the otic capsule, the round window membrane, and the oval window membrane.

2. The hearing aid device according to claim 1, wherein the pulsed light source is a pulsed laser or a light emitting diode (LED).

3. The hearing aid device according to claim 1, wherein the output surface is the cross-sectional surface of an optical fibre.

4. The hearing aid device according to claim 1, wherein the output surface is a surface of a lens arranged at the cross-sectional surface of an optical fibre.

5. The hearing aid device according to claim 1, wherein the output surface is arranged in an angle of 0 to 90° from the longitudinal fibre axis.

6. A hearing aid device according to claim 1, wherein the output surface is spaced from the functional element of the natural vibration transduction pathway by a distance of 0.1 μm-5 cm.

7. A hearing aid device for a hearing impaired human having an at least partially functional cochlea, the device comprising a pulsed light source capable of producing pulsed irradiation, a control unit coupled to the pulsed light source for controlling and modulating the frequency of pulsed irradiation, and at least one optical fibre optically coupled to the pulsed light source for reception of pulsed irradiation produced by the pulsed light source, wherein the pulsed light source and the optical fibre form an optical path terminating in an output surface adapted to emit pulsed irradiation from the end section of the optical fibre opposite the pulsed light source, and wherein the optical fibre is dimensioned for termination in the output surface adjacent to and spaced from an at least partially functional element of the natural vibration transduction pathway for transmission of irradiation from the output surface to the functional element of the natural vibration transduction pathway, which functional element is functionally coupled for transduction of vibration to the cochlea and is selected from the group comprising the skull, the tympanic membrane, the hammer, the incus, the stapes, the outside of the cochlea, the otic capsule, and the oval window membrane.

8. The hearing aid device according to claim 7, wherein the pulsed light source is a pulsed laser or a light emitting diode (LED).

9. The hearing aid device according to claim 7, wherein the output surface is the cross-sectional surface of an optical fibre.

10. The hearing aid device according to claim 7, wherein the output surface is a surface of a lens arranged at the cross-sectional surface of an optical fibre.

11. The hearing aid device according to claim 7, wherein the output surface is arranged in an angle of 0 to 90° from the longitudinal fibre axis.

12. A hearing aid device according to claim 7, wherein the output surface is spaced from the functional element of the natural vibration transduction pathway by a distance of 0.1 μm-5 cm.

* * * * *

UNITED STATES PATENT AND TRADEMARK OFFICE

CERTIFICATE OF CORRECTION

PATENT NO. : 8,600,089 B2
APPLICATION NO. : 13/146804
DATED : December 3, 2013
INVENTOR(S) : Gentiana I. Wenzel et al.

It is certified that error appears in the above-identified patent and that said Letters Patent is hereby corrected as shown below:

On the Title Page:

(75) Inventors:

Left Column, line 3 — Please delete "Hubert H. Lim, Hannover (DE);" and insert --Hubert H. Lim, Minneapolis, MN (US);-- therefor.

In the Specification:

| | |
|---|---|
| Col. 1, line 60 | Please delete "bra instem" and insert --brainstem-- therefor. |
| Col. 3, line 30 | Please delete "1180" and insert --1108-- therefor. |
| Col. 8, line 11 | Before "the generation", please delete "effects" and insert --affects-- therefor. |
| Col. 11, line 39 | Please delete "1-300/pulse" and insert --1-30μJ/pulse-- therefor. |
| Col. 12, line 54 | Please insert a --.-- between "MHz" and "Suitably". |
| Col. 14, line 19 | Please delete "scull" and insert --skull-- therefor. |
| Col. 14, line 29 | Please delete "scull" and insert --skull-- therefor. |
| Col. 14, line 52 | After "which is", please delete "a". |
| Col. 15, line 65 | Please delete "scull" and insert --skull-- therefor. |
| Col. 18, line 60 | Please delete "walle" and insert --wall-- therefor. |

Signed and Sealed this
Twelfth Day of August, 2014

Michelle K. Lee

Michelle K. Lee
*Deputy Director of the United States Patent and Trademark Office*